United States Patent [19]

Obstfelder et al.

[11] Patent Number: 4,567,489

[45] Date of Patent: Jan. 28, 1986

[54] THERMAL PRINTHEAD FOR THERMOGRAPHIC PRINTER

[76] Inventors: Günther Obstfelder, Panoramastrasse 28, 6940 Weinheim-Lützelsachsen; Gerhard Kreutze, Kirchenstrasse 38; Winfried Lüttig, Lange Acker 16, both of 6901 Neckarsteinach, all of Fed. Rep. of Germany

[21] Appl. No.: 568,095

[22] Filed: Jan. 4, 1984

[30] Foreign Application Priority Data

Jan. 4, 1983 [DE] Fed. Rep. of Germany ..... 3300104

[51] Int. Cl.[4] ..... H05B 1/00

[52] U.S. Cl. ..... 346/76 PH; 219/543; 219/216; 338/308

[58] Field of Search ..... 346/76 R, 76 PH; 219/216, 216 PH, 539, 543, 10.47, 10.81; 400/120; 144/32 G, 6.5; 338/308

[56] References Cited

U.S. PATENT DOCUMENTS 3,764,767 10/1973 Randolph ..... 346/76 PH 4,482,239 11/1984 Hosono et al. ..... 219/216

*Primary Examiner*—E. A. Goldberg

*Assistant Examiner*—A. Evans

*Attorney, Agent, or Firm*—Staas & Halsey

[57] ABSTRACT

A thermal printhead for a thermoprinter having an electrically insulating substrate on which resistors are placed that form impression points and current supply and current discharge leads bonded to the resistors. A structure is provided in this thermal printhead for forming a magnetic field which acts upon the resistors in the immediate proximity of the resistors and along the resistor print line. The magnetic field is directed such that when the current flows through the resistors, the current paths within the resistors are deflected upwardly into the upper part of the resistor to the outer surface thereof. This thermal printhead has the advantage that the single resistor impression points reach their highest temperature at the printing surface, that is, at the site where the single impression point must deliver the heat to the recording medium. This results in the amount of heat needed for the heating of the resistor being supplied more quickly to the recording medium, thereby reducing the cooling time of the single resistor impression point so that a higher printing velocity can be attained with the thermal printhead.

19 Claims, 6 Drawing Figures

THERMAL PRINTHEAD FOR THERMOGRAPHIC PRINTER

BACKGROUND OF THE INVENTION

1. Field of the Invention

The invention relates to a thermal printhead for a thermal printer comprising an electrically insulating substrate on which resistors are placed that form impression points, as well as current supply leads and current discharge leads bonding the resistors.

2. Description of the Prior Art

West German Patent Publication No. 25 37 142 discloses a thin-film thermal printhead with a substrate, a glass layer on the substrate, heating elements of high-resistivity material, a plurality of electrical conductors connected to the heating elements for the supply of electrical power, and a top layer made of wear-resistant material with a relatively high heat conductivity. Gold or aluminum is used as conducting material for producing the electric conducting paths for supplying current to, and discharging it from, the single resistor impression points. This material for the electric conducting paths, is, for example, deposited by evaporation or by cathode sputtering and bonded with the single resistor.

However, since the height of the gold layer is considerably less than the height of the single resistors, current distribution during operation occurs only on the level of the gold layer within the resistors so that, due to the resultant heat distribution, the upper edges and the upper portion of the resistor are not heated sufficiently. Furthermore, the metal conducting layer dissipates the heat very quickly. These disadvatages lead to an unsatisfactory heat distribution within the resistor, so that more current is required for the heating thereof. However, this advantage persists even with more current in that the greatest current density is within the lower part of the resistor, i.e., on the level of the bonding. Therefore, the highest temperature prevails at the foot of the resistor between the bonding of both conducting paths instead of in the upper part of the resistor as is required.

It should be noted that the term "resistor" is synonymous with the terms "resistance element" and "heating element."

SUMMARY OF THE INVENTION

Therefore, the major object of the invention is to provide a thermal printhead of the kind mentioned in the "Background of the Invention" section, in which the single resistor is heated at least uniformly, preferably in its upper region above the bonding.

According to the invention, this object is achieved by a thermal printhead for a thermal printer comprising an electrically-insulated substrate, resistors arranged on an electrically-insulating substrate in a print line to form impression points, current supplying current discharge leads bonded to the resistors, means for forming a magnetic field in the immediate proximity of the resistors and along the resistor print line for acting upon the resistors, the magnetic field being directed such that when current flows through the resistors, the current paths within the resistors are deflected upwardly into the upper portion of the resistor to the surface thereof.

The thermal printhead of the invention offers the advantage that the single resistor impression points reach their highest temperature at the printing surface, that is to say, exactly at the site where the single impression point must deliver the heat to the recording medium. This results in the further advantage that the amount of heat needed for the heating of the resistor is supplied more quickly to the recording medium, thereby reducing the cooling time of the single resistor impression point, so that a higher printing velocity can be attained with the thermal printhead.

The invention takes advantage of the fact that energized conductors in a homogeneous magnetic field are subjected to mechanical forces which, with an antiparallel direction of flow, deflect the two conductors outwardly, the two conductors repelling one another (Moeller, "Grundlagen der Elektrotechnik," 1963, 12th edition, p. 133).

Therefore, in accordance with the invention, the current paths are deflected within the single resistor or resistor by a separate magnetic field in such a way that the current paths are deflected upwardly into the upper part of the resistors toward the surface. In principle, this can be done (1) by the magnetic field of a permanent magnet whose poles are arranged above and below the resistor print line therealong and whose polarity is directed such that, even with an energized resistor, the current paths are deflected upwards toward the surface; or (2) by the magnetic field generated by a conductor fitted below each resistor and insulated therefrom. This conductor also carries current when the resistor is energized. In this latter technique, the current flowing through the conductor must be antiparallel to the current flowing through the conductor. Thus, the action of the magnetic field is always important.

Similarly, in the latter technique of a conductor arranged below each resistor and electrically insulated therefrom, magnetic fields are generated around the conductor below the resistor and around the current paths within the resistor. With antiparallel or opposing directions of flow, the magnetic fields will attempt to push the conductors away from one another. Since the conductor located below the resistor is fixed and a higher density of energy prevails between the conductors than to the left or to the right of the conductor or of the current paths within the resistor, the current paths within the resistor are deflected upwards into the upper part thereof toward the surface in conformity with the physical theorem of minimum energy. As a result, the object of the heating the upper part of the resistor is again achieved. Preferably, the heat is produced at the site of consumption, i.e., directly at the surface of the resistor across which the paper is in the thermal printer.

Advantageously, because the conductor is arranged beneath the resistor, the exact current needed for activating that resistor impression point can be sent in antiparallel direction.

Therefore, it is of importance that in the design with a magnet or with a current path beneath the resistor, the external magnetic field be directed such that the magnetic field lines of this external magnetic field with push aside the magnetic field lines of the current paths within the resistor, so that the current paths within the resistor are deflected upwards toward the surface thereof.

BRIEF DESCRIPTION OF THE DRAWINGS

The present invention is illustrated in the accompanying drawings, wherein.

DETAILED DESCRIPTION OF THE PREFERRED EMBODIMENTS

Figure 1:
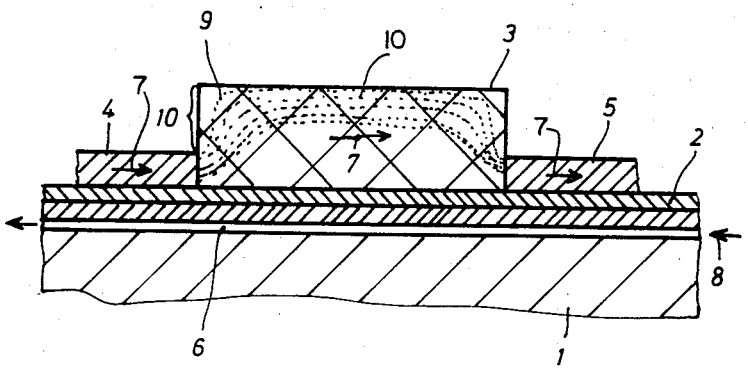
FIG. 1 is a partial sectional view of a thermal printhead for a thermal printer in accordance with a first embodiment of the invention, illustrating in particular a resistor impression point on a substrate of a thermal printhead wherein the resistor impression point has current supply and discharge loads bonded thereto and another current path is arranged below the resistor impression point and electrically insulated therefrom.

FIG. 1 shows an embodiment of a thermal printhead for a thermal printer in accordance with the invention. The thermal printhead comprises a substrate 1 on which has been deposited a resistor layer subdivided into single resistors or resistor impression points 3. These resistors 3 have a conical or cubic shape. At the side of each resistor 3, preferably opposite thereto, the extends along each resistor thin conductors 4, 5, preferably formed of gold, and acting as current supply and discharge leads to the resistor. These thin gold conductors are thus bonded to each resistor impression point 3, preferably at the front ends thereof or in the area of the front ends, as shown in the drawings. The thin gold layers of the conductors 4, 5 are deposited by evaporation or printed thereon, as known from the prior art.

Below each resistor impression point 3 and below an insulating layer 2 there extends a conductor 6 in the longitudinal direction of the resistor impression point which likewise is preferably deposited by evaporation or printed thereon, as known from the prior art. A parallel conductor 6 is assigned to each resistor impression point 3.

During the operation of the thermal printhead, the single resistor impression point 3 are activated in conformity with the printing program. At the same time, the conductor 6 lying therebelow is activated in such a way that the electric current flow 8 through conductor 6 is directed antiparallel to the direction of flow 7 in the associated resistor impression point 3. Due to the resultant magnetic field distribution and to the principle of minimum energy, conducting paths 9 within resistor 3, which otherwise would preferably be formed in the lower part of resistor impression point 3 up to the level of gold bonding 4,5, are deflected into the upper part 10 of resistor impression point 3. In FIG. 1, the deflected conducting paths 9 are indicated by a dotted line. The directions of flow in the current supply and current discharge leads 4, 5, in the resistor impression point 3 and in condutor 6, are indicated by the directional arrows 7 and 8.

All conductors 6 located beneath the resistor impression points of a resistor layer can be continuously energized antiparallel to the direction of flow 7 within the single resistor impression points. However, in order to lower the energy consumption, it is advisable to energize the conductors 6 assigned to the single resistor impression points 3 antiparallel only when the associated resistor impression point 3 is activated.

Preferably, the conductor 6 beneath the single resistor impression point 3 is a flat-type conductor, the width of the conductor beneath the single resistor point having the width of the resistor impression point.

Furthermore, the conductor 6 is located in the immediate proximity beneath the single resistor impression point 3. The closer the conductor 6 can be brought toward the underside of the resistor impression point 3, the greater the upward deflecting action of the conducting paths 9 within the resistor impression point 3 while the current through the conductor 6 therebelow remains constant.

Figure 2:
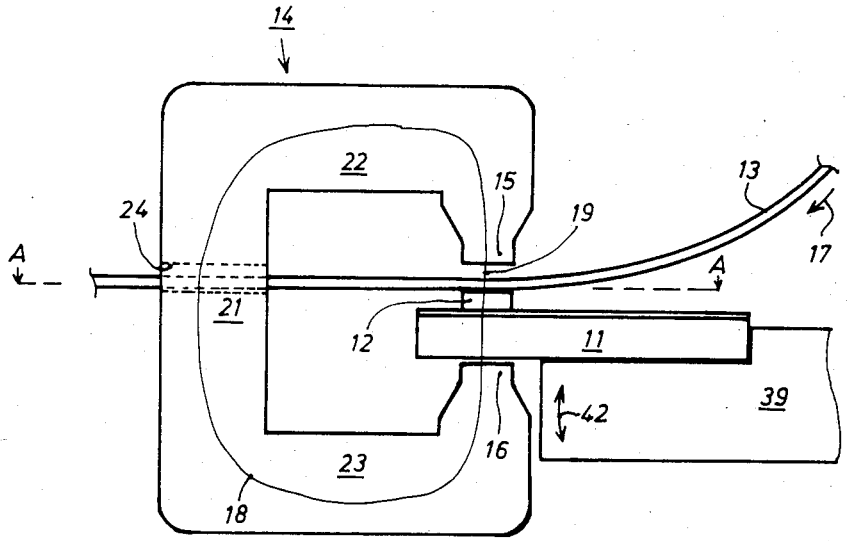
FIG. 2 is a schematic view of another embodiment of a thermal printhead for a thermal printer in accordance with the invention using a permanent magnet for the generation of a deflecting magnetic field, wherein the poles of the permanent magnet have the length and width of the resistor print line and are aligned therealong, so that the magnetic field within the air gap of the permanent magnet passes through the resistor print line.
Figure 3:
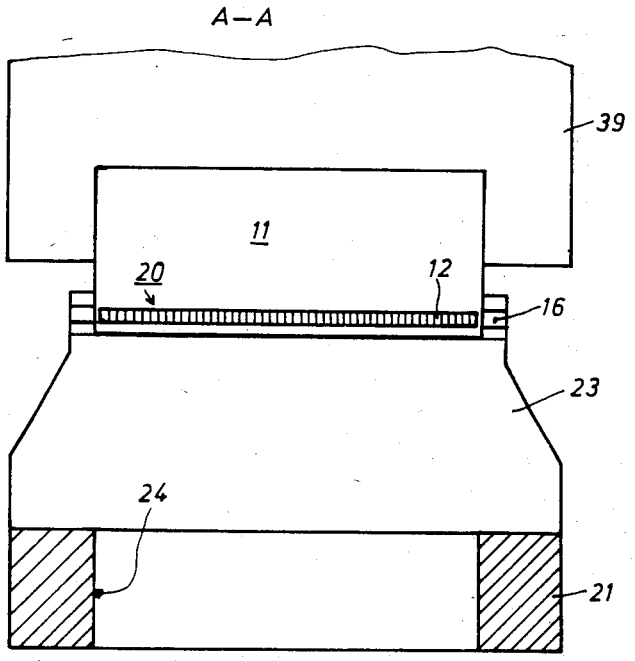
FIG. 3 is a top plan view of the permanent magnet shown in FIG. 2, taken along the line A—A in FIG. 2.

FIGS. 2 and 3 show the schematic arrangement of a thermal printhead according to a variant form of the embodiment of FIG. 1, wherein a permanent magnet is used for generating the deflecting magnetic field.

A permanent magnet, e.g., a double-L magnet or a horseshoe magnet 14, comprises a connecting portion 21 to which are fitted two limbs 22, 23 whose end portions take the form of poles 15, 16. The surfaces of these poles 15, 16 face one another plane-parallel and have the length and width of the resistor print line. The width of poles 15, 16 relative to the width of the single resistor impression point 12 is shown in FIG. 2 and the width of poles 15, 16 relative to the length of resistor print line 20 is shown in FIG. 3. Thus, between poles 15, 16 of permanent magnet 14 there is an air gap in which issue the magnetic lines of force 18 of permanent magnet 14 to form a magnetic field 19 comprising parallel flux lines which pass substantially vertically through the surfaces of poles 15, 16.

In the air gap, there is provided a thermal printhead 11 arranged on a resistor print line 20 (FIG. 3) comprised of single resistors 12 (FIGS. 2 and 3). Upper pole 15 of upper limb 22 of permanent magnet 14 is thus spaced a certain distance directly above resistor print line 20, and lower pole 16 of lower limb 23 of permanent magnet 14 lies directly beneath thermal printhead 11 in projection likewise beneath resistor print line 20. Upper pole 15 of permanent magnet 14 is spaced a small distance from resistor print line 20, so that a paper web 13 to be printed can pass between upper pole 15 and resistor print line 20. For example, reference arrow 17 in FIG. 2 indicates the direction of transport of the power web. Thermal printhead 11 is properly retained on a support 39 which, in turn, is held in the press (not shown). Preferably, support 39 is swivel-mounted so that resistor print line 20 can be swung in the direction of upper pole 15 of permanent magnet 14 and back, as shown by reference arrow 42 in FIG. 2. During the printing, thermal printhead 11 can be swivel toward upper pole 15, so that paper web 13 is pressed between thermal printhead 11 and upper pole 15. To this end, pole 15 can have a bearing (not shown) of elastic material, e.g., rubber, which does not affect the permeability of the magnetic flux lines 18.

Permanent magnet 14 has in its connecting portion 21 between limbs 22 and 23 a narrow window 24 through which paper web 13 is passed. Window 24 can lie in the same plane as resistor print line 20, as shown in FIG. 3. However, the window can also be rotated 90° so that the paper web between resistor print line 20 and the window in rotated 90°. In this way, the paper web can be moved past the connecting portion 21 upon 90° rotation after the resistor print line.

Figure 6:
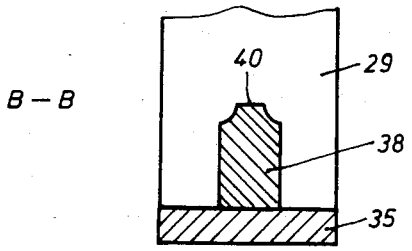
FIG. 6 is a cross-sectional view taken along the line B—B in FIG. 5, showing the cross section of the plate and of the knife-edge raised part, i.e., the bar and the pole rail, for the embodiment of FIG. 4.
Figure 4:
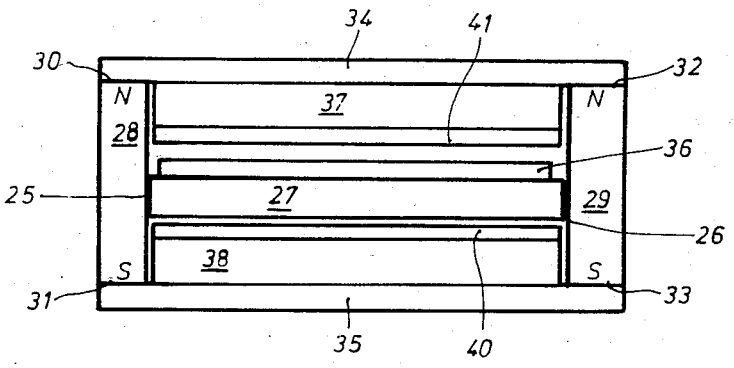
FIG. 4 is a schematic view of another embodiment of a thermal printhead for a thermal printer in accordance with the invention using two permanent magnets arranged on both edges of the thermal printhead and connected together by means of two soft-iron plate.
Figure 5:
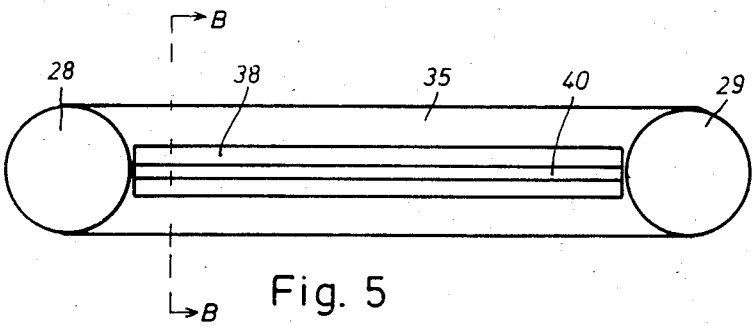
FIG. 5 is a partial sectional view of the embodiment of FIG. 4, illustrating in particular the alignment of the poles of the two magnets in relationship to the continuous rails formed on a knife-edge bar of one of the two soft-iron plates along the thermal printhead.

FIGS. 4, 5 and 6 show another embodiment of the thermal printhead of the invention compared to the variant form of FIGS. 2 and 3 for producing the deflecting magnetic field by means of permanent magnets.

A thermal printhead 27 is again properly held on a support (not shown) which, in turn, is placed within the press (not shown). Thermal printhead 27 carries in a known manner a resistor print line 36 which again comprises single resistors.

On both edges 25, 26 of thermal printhead 27, two bar-shaped permanent magnets 28, 29 are arranged perpendicularly to the main plane thereof and which preferably have a cylindrical shape (FIG. 5). Poles 30, 32 and 31, 33 of the respective permanent magnets 28, 29 are connected together by means of corresponding soft-iron plates 34, 35, so that the plates are aligned plane-parallel to one another. Each plate connects equidirectional poles, i.e., plate 34 connects the respective north poles 30, 32 of permanent magnets 28, 29, and plate 35 connects the respective south poles 31, 31 of magnets 28, 29 in like manner.

Plates 34, 35 have on the side turned toward thermal printhead 27 a knife-edge raised part 37, 38 which thus takes the form of a bar. These bars 37, 38 extend along resistor print line 36. The edge section of bars 37, 38 is formed as a continuous pole, or pole rails 40, 41 (FIG. 6), with the pole rails 40, 41 of corresponding bars 37, 38 being placed directly above resistor print line 36.

Bar 38 or the pole rail 40 of bar of plate 35 reaches up to the underside of thermal printhead 27. Bar 37 or pole rail 41 of bar 37 of plate 34 is spaced a small distance from resistor print line 36 so that a paper web (not shown) can pass between pole rail 41 and resistor print line 36.

Both pole rails 40, 41 thus form an air gap along resistor print line 36. Since the length of permanent magnets 28, 29 is greater by a multiple than the vertical distance between pole rails 40, 41 from each other or greater than the resultant air gap, the lines of force issuing from permanent magnets 28, 29 run within soft-iron plates 34, 35. Thus, two magnetic fields are formed within the air gap between pole rails 40, 41, i.e., one pertaining to permanent magnet 28 and the other is permanent magnet 29.

In this way, a strong permanent magnetic field is always present during the energization time of the resistor impression points, the magnetic field passing through the resistor impression points and being directed such that the current paths within the resistor impression points are deflected upwards toward the surface thereof and thereby toward the paper web.

The use of a permanent magnet for the generation of the deflecting magnetic field offers the advantage that very strong magnetic fields can be produced, so that a strong deflection of the flow lines within the single resistor impression points is achieved. Thus, the power required for the energization of the single resistor impression points can be reduced further, so that the heat to be dissipated is diminished and the printing velocity of the press and thereby its power is increased.

Although the invention has been described above with respect to the preferred embodiments of the thermal printhead for a thermal printer, it will be appreciated by those skilled in the art that various modifications and variations in the foregoing are possible. For example, both alternatives noted above for producing the deflecting magnetic field could be combined to advantage. Moreover, the permanent magnet for producing the deflecting magnetic field can be designed such that it is shaped like a horseshoe with two limbs and poles as shown in FIG. 2, but with the limbs bent at right angles or offset in their plane. In this latter modification, the connecting portion of the permanent magnet is fitted between both limbs on one of the edges of the thermal printhead, whereas the poles or the pole rails again extend directly above or below the resistor print line of the thermal printhead. Thus, the paper web passes between the poles of the permanent magnet and then moves past the connecting portion of the two limbs. The movement of the paper web is not hindered by the shape or arrangement.

We claim:

1. A thermal printhead for a thermal printer comprising:

(a) an electrically-insulating substrate;

(b) resistors arranged on an electrically-insulating substrate in a print line to form impression points;

(c) current supply and current discharge leads bonded to the resistors; and (d) means for forming a magnetic field to act upon the resistors in the immediate proximity of the resistors and along the resistor print line, the magnetic field being directed such that when current flows through the resistors, the current paths within the resistors are deflected upwardly into the upper portion of the resistor to the surface thereof.

2. The thermal printhead of claim 1, wherein the means for forming the magnetic field comprises a permanent magnet having poles arranged along the resistors above and beneath the thermal printhead, the poles of the permanent magnet having magnetic flux lines penetrating the resistors vertically.

3. The thermal printhead of claim 2, wherein said permanent magnet is a horseshoe magnet having poles with the length and the width corresponding to the resistor print line on the thermal printhead and wherein the poles are arranged above and beneath the thermal printhead.

4. The thermal printhead of claim 3, wherein the horseshoe magnet has a pair of limbs, a connecting portion connecting said limbs, and a window formed in the connecting portion through which a paper web is passed.

5. The thermal printhead of claim 1, wherein said means for forming the magnetic field comprises bar-shaped permanent magnets positioned on both edges of the thermal printhead in the same direction of polarity, soft-iron plates connecting the equidirectional poles and arranged plane-parallel to one another above and beneath the thermal printhead, the plates having a knife-edge raised part on the side turned toward the thermal printhead directly above and beneath the resistor print line so as to form longitudinal poles whose distance from one another is smaller than the height of the permanent magnets.

6. The thermal printhead of claim 1, wherein the means for forming the magnetic field comprises a conductor provided beneath each of the resistors to produce deflecting magnetic field, the conductors being electrically insulated from the resistors and through which a current flows in a direction antiparallel to the current of that provided to the resistor when the resistor is energized.

7. The thermal printhead of claim 6, wherein said resistors and said conductors are deposited on a substrate and wherein an insulating layer is provided between the resistors and the conductors located therebelow and corresponding to said resistors.

8. The thermal printhead of claim 7, wherein said resistors and said conductors are deposited on said substrate by a multilayer thick-film process.

9. The thermal printhead of claim 6, wherein said conductor beneath said resistor impression point has the width of said resistor impression point.

10. The thermal printhead of claim 7, wherein said conductor beneath said resistor impression point has the width of said resistor impression point.

11. The thermal printhead of claim 6, wherein the current flows through said conductor when the current flows through said resistor corresponding to said conductor.

12. The thermal printhead of claim 7, wherein the current flows through said conductor when the current flows through said resistor corresponding to said conductor.

13. The thermal printhead of claim 9, wherein the current flows through said conductor when the current flows through said resistor corresponding to said conductor.

14. The thermal printhead of claim 10, wherein the current flowing through said conductor when the current flows through said resistor corresponding to said conductor.

15. The thermal printhead of claim 6, wherein said conductors continuously carry current.

16. The thermal printhead of claim 7, wherein said conductors continuously carry current.

17. The thermal printhead of claim 9, wherein said conductors continuously carry current.

18. The thermal printhead of claim 10, wherein said conductors continuously carry current.

19. The thermal printhead of claim 3, wherein said horseshoe magnet has a pair of limbs and a connecting portion, the limbs of said horseshoe magnet being bent 90° in their plane and placed along, above or beneath said resistor print line and the connecting portion of the horseshoe magnet being arranged on the side at right angles to said resistor print line of said thermal printhead.

* * * * *